United States Patent [19]

Samagalsky

[11] Patent Number: 4,891,265

[45] Date of Patent: Jan. 2, 1990

[54] PACKAGED SHEET FOR CLEANING FACSIMILE MACHINES

[75] Inventor: William N. Samagalsky, Toronto, Canada

[73] Assignee: XLNOW Trading Corporation, Toronto, Canada

[21] Appl. No.: 271,510

[22] Filed: Nov. 15, 1988

[51] Int. Cl.[4] ..... D04H 1/08

[52] U.S. Cl. ..... 428/280; 15/104.43; 428/282; 428/229

[58] Field of Search ..... 428/280, 282, 289; 15/104.93

[56] References Cited

U.S. PATENT DOCUMENTS 4,611,361 9/1986 Shinkai ..... 428/182

*Primary Examiner*—James J. Bell

*Attorney, Agent, or Firm*—Donald E. Hewson

[57] ABSTRACT

The Invention concerns a packaged sheet for cleaning rollers of a facsimile machine. A sheet of a suitable size and weight for passing through a facsmile machine is impregnated with cleaning fluid, for example isopropyl alcohol. The amount of isopropyl alcohol should be sufficient for roller cleaning but not in so great excess that surplus is left on the roller after passage of the sheet. Each sheet is individually sealed in flat, unfolded condition in a fluid tight package. The package may comprise at least two layers, one being of foil and the other being of plastic material.

7 Claims, 1 Drawing Sheet

PACKAGED SHEET FOR CLEANING FACSIMILE MACHINES

BACKGROUND OF THE INVENTION

1. Field of the Invention

The invention relates to a storable pack comprising a sheet material for cleaning the inside surface of conveyor rolls of a facsimile apparatus.

2. Background of the Invention

In a facsimile apparatus the copy to be transmitted is delivered into the apparatus by means of conveyor rolls, and while the copy passes between the conveyor guides the letters, characters, figures, diagrams, etc, are read, following which the copy is discharged externally of the apparatus by means of discharge rolls. Paper for recording received messages is placed in advance in the facsimile apparatus, and after having had data recorded on it is discharged. These paper conveyor rolls accumulate dirt, oils and other foreign substances during use. When the copy used for transmission and the paper on which received messages have been recorded are discharged from such an apparatus, the surface of these rollers become soiled. For preventing such a situation, it has been the practice in the past to remove the soil by wiping the sufaces of the rolls and inside surface of the guides with a soft paper or rag impregnated with a cleaning fluid. It was however necessary in this case of such a method to disassemble the apparatus for exposing the rolls and guides. There was thus the drawback that time and labor were required.

U.S. Pat. No. 4,611,361 issued Sept. 16th 1986 to Shinkai discloses a sheet material cleaner which may be passed, like paper between the conveying rolls. Shinkai's sheet material is impregnated with a cleaning fluid and is provided with a follower absorbent sheet to wipe excess cleaning fluid from the rollers. Each sheet and attached follower sheet may be packaged in a plastic bag and each impregnated sheet may have plastic adhered to each side to presumably inhibit cleaning fluid from reaching the absorbent follower sheet while in the package.

Shinkai's packaged facsimile apparatus cleaning sheet was the subject of a patent application in Japan in 1984 and was assigned to two Japanese companies active in the field of art. However, in 1988, disassembly of facsimile apparatus for cleaning was still a normal procedure.

SUMMARY OF THE INVENTION

The present inventor made two surprising discoveries. Firstly, the use of an absorbent follower sheet is not always desirable due to the great difficulty in ensuring that it does not leave its own detritus such a lint on the rolls. Secondly, plastic materials usually regarded as impermeable to liquids allow appreciable liquid loss therethrough when used in their sheets for packaging sheet material impregnated with cleaning fluid.

With these two facts in mind an attempt was made to provide a storable packaged facsimile apparatus cleaning sheet for the conveyor rollers for transmitted copy without the necessity for using a second or attached absorbent sheet.

The main problem encountered was the necessity of devising a sheet impregnated with a minimal quantity of cleaning fluid so that there would be no excess for removal from the rollers, while ensuring that sufficient liquid was present. This involved the provision of liquid impregnant in very narrow limits. Thus the second problem of packaging was acute.

Accordingly the invention provides individually packaged sheet material for cleaning facsimile machine conveyor rollers for either transmitted copy or received copy, comprising; a single planar, felted mat sheet impregnated with an amount of cleaning fluid and having stiffness whereby it is adapted to be passed between facsimile machine paper conveying rollers, and having compressiblity whereby it is adapted to wipe the surface of said paper conveying rollers with said cleaning fluid; the amount of cleaning fluid being only sufficient to contact the surface of the conveying rollers during passage therebetween of said sheet material; and each planar, felted mat sheet being sealed in unfolded condition within foil packaging impermeable to said cleaning fluid.

As the cleaning fluid, there can be mentioned, for example the freon-type detergents, lower alcohols, neutral detergents and water. Further, if an antistatic agent and/or an antifungal agent is added to these cleaning fluids, the paper conveying rolls can not only be cleaned but also be given an antistatic and or antifungal treatment. Particularly suitable as cleaning fluid is isopropyl alcohol.

BRIEF DESCRIPTION OF THE DRAWINGS

An embodiment of the invention will now be described, by way of example, with reference to the drawings in which.

DETAILED DESCRIPTION OF PREFERRED EMBODIMENTS

Figure 1:
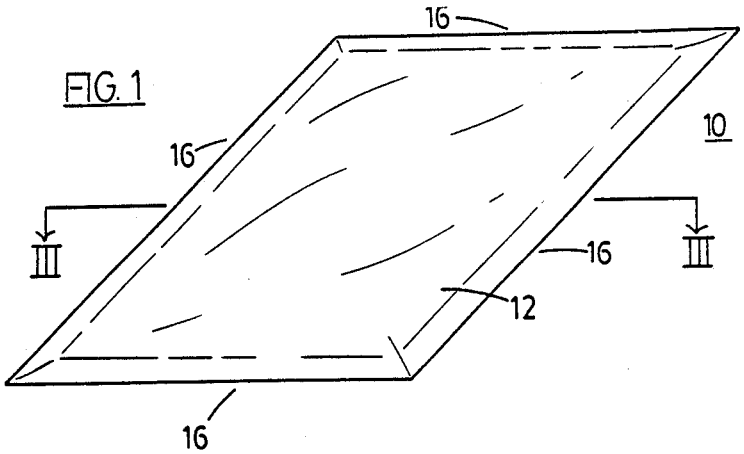
FIG. 1 is a sketch of one embodiment of packaged facsimile apparatus cleaning sheet.
Figure 2:
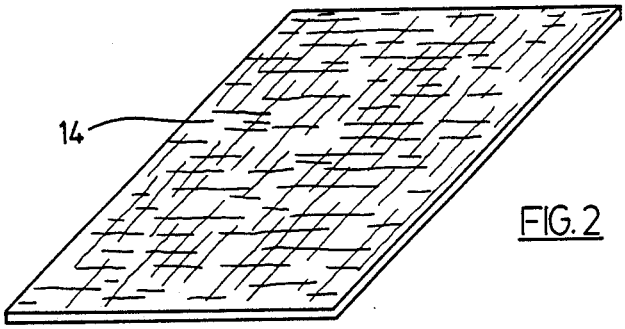
FIG. 2 is a sketch of a planar, felted mat sheet for packaging in the package of FIG. 1.
Figure 3:
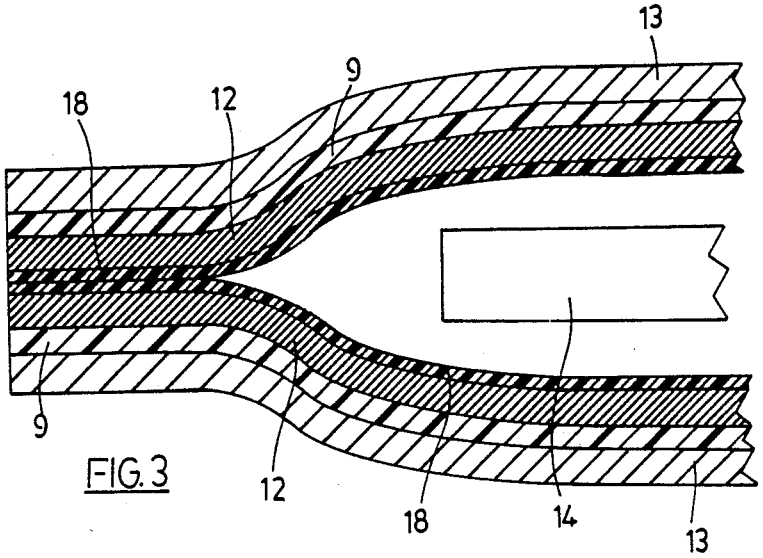
FIG. 3 is a section of part of the package of FIG. 1 on the line III—III.

In the drawings a package 10 comprises upper and lower sheets of aluminum foil 12 sealed around a rectangular, planar, felted mat sheet 14 impregnated with isopropyl alcohol. Sealing is at margins 16 of foil 12 whereby sheet 14 is totally enclosed and sealed within the package 10.

Sealing at margins 16 may be accomplished by an inner layer 18 of thermoplastic material laminated to the foil and by heat sealing of the abutting surfaces of the margins of the layer 16. The thermoplastic material may be, for example, an ionomer resin such as a copolymer of ethylene with a methacrylic monomer, such as that which is sold under the Trade Mark SURLYN by Dupont (EI)de Nemours.

The inner layer, as shown is a layer 18 of SURLYN approximately 1 mm in thickness. Laminated to the SURLYN is a layer of aluminum foil 12 about 0.007 mm thick. Over the foil is a layer of polyethylene 9 weighing about 11.5 gm/sq. m and outside the polyethylene is an outside paper layer 13 weighing approximately 4 gms/sq. m. These quoted characteristics are those of an actual sample, but it will be appreciated that none of the above figures are critical to the invention. The outer covering of paper is provided for facility in printing advertising and/or instructional material on the outside of the pack and is not itself an important feature of the invention.

As shown the package is sealed at all its margins but it may equally well be wrapped and sealed only at edges where necessary. For example a package may be sealed at its ends and along an edge with a surface extending between the ends.

The sheet 16 may suitably be a random matte of polyester material as is normally sold as interfacing in the clothing industry. A suitable material is sold under the trade mark PELLON and can be obtained from Nonwovens Inc. Cornwall, Ontario. The thickness of the sheet may be around 0.84 mm but lesser or greater thicknesses are possible. It is important that the sheet 16 lie flat and unfolded in the packaging since any folds in the sheet 16 would tend to concentrate the impregnant unevenly.

The amount of the isopropyl alcohol must be carefully chosen so that there is sufficient impregnant to contact the surfaces of conveyor rollers of a facsimile machine when the sheet is passed therebetween, but not sufficient to be left on the surfaces of the rollers to redistribute dirt thereon. A suitable amount of isopropyl alcohol evenly distributed on an approximately letter size sheet, 8 and ½ inches by 11 inches may be in the range of 2.5 to 7.5 ml/sheet and preferably in the range of 5 ml/sheet, i.e. about 0.009 ml/sq. cm.

In use the foil package is broken open by the user and the enclosed sheet is immediately passed between the conveyor rolls which it is desired to clean. It is important that use should be immediate since isopropyl alcohol is highly volatile, and the amount on the sheet is calculated to clean the rollers without leaving any excess liquid thereon.

I claim:

1. Individually packaged sheet material for cleaning facsimile machine conveyer rollers for either transmitted copy or received copy, said packaged sheet material comprising a single planar, felted mat sheet impregnated with an amount of cleaning fluid and having stiffness whereby it is adapted to be passed volatization thereof, and once the package is opened the cleansing sheet therein should be used immediately because there is a predetermined amount of cleaning fluid impregnated in the sheet material, and that cleaning fluid is volatile.

2. Individually packaged sheet material as claimed in claim 1 in which the cleaning fluid is isopropyl alcohol.

3. Individually packaged sheet material as claimed in claim 1 in which the foil has an inner layer of thermoplastic material.

4. Individually packaged sheet material as claimed in claim 1 in which the amount of isopropyl alcohol is about 0.009 ml/sq. cm.

5. Individually packaged sheet material as claimed in claim 1 in which the planar, felted mat sheet is a randomly felted polyester sheet.

6. Individually packaged sheet material as claimed in claim 1 in which the planar, felted mat sheet has a thickness of 0.84 mm.

7. Indivdually packaged sheet material as claimed in claim 1 in which the planar, felted mat sheet is approximately 8.5 inches by 11 inches.

* * * * *